US007343706B2

(12) United States Patent
McGarry

(10) Patent No.: US 7,343,706 B2
(45) Date of Patent: Mar. 18, 2008

(54) CAMBLOCK ASSEMBLY FOR A FIREARM

(75) Inventor: James McGarry, Prescott Valley, AZ (US)

(73) Assignee: Sturm Ruger & Co., Inc., Southport, CT (US)

( * ) Notice: Subject to any disclaimer, the term of this patent is extended or adjusted under 35 U.S.C. 154(b) by 149 days.

(21) Appl. No.: 11/286,943

(22) Filed: Nov. 22, 2005

(65) Prior Publication Data

US 2006/0101989 A1 May 18, 2006

Related U.S. Application Data

(62) Division of application No. 10/821,512, filed on Apr. 9, 2004, now Pat. No. 7,103,998.

(51) Int. Cl.
*F41A 3/00* (2006.01)

(52) U.S. Cl. ..... 42/16; 42/34; 42/38; 42/69.02; 89/145; 89/162

(58) Field of Classification Search ..... 42/16, 42/34, 38, 69.02; 89/145, 162
See application file for complete search history.

(56) References Cited

U.S. PATENT DOCUMENTS

| | | | |
|---|---|---|---|
| 3,435,728 | A | 4/1969 | Pachmayr et al. |
| 5,309,815 | A | 5/1994 | Moller et al. |
| 5,465,645 | A | 11/1995 | Cominolli |
| 5,581,046 | A | 12/1996 | Weldle et al. |
| 5,741,996 | A | 4/1998 | Ruger et al. |
| 2001/0029688 | A1 | 10/2001 | Beretta |

*Primary Examiner*—J. Woodrow Eldred
(74) *Attorney, Agent, or Firm*—Wildman, Harrold, Allen & Dixon LLP

(57) ABSTRACT

A camblock assembly with a camblock and a guide rod is employed in a firearm having a frame constructed of synthetic polymer material. The camblock has a front flange with flange surfaces that engage corresponding bearing surfaces of the frame to distribute forces and energy to the frame during recoil of the firearm. A shelf member is positioned at a front end of the camblock and a coiled flat wire buffer spring is positioned about the guide rod to resist movement of a reciprocating slide. A detent mechanism positioned within the camblock contacts a surface of a slide stop pin to hold the slide stop latch in place. The interior of the slide stop latch contains an elongated wire having an end that engages the frame such that the slide stop latch is biased in a down position.

7 Claims, 6 Drawing Sheets

CAMBLOCK ASSEMBLY FOR A FIREARM

CROSS-REFERENCE TO RELATED APPLICATIONS

This application is a divisional of prior application Ser. No. 10/821,512, filed Apr. 9, 2004 now U.S. Pat. No. 7,103,998.

BACKGROUND OF THE INVENTION

Autoloading pistols have employed synthetic polymer frames to reduce weight, lower manufacturing costs and increase corrosion resistance. Such pistols have utilized metallic inserts positioned in the synthetic polymer frame to allow the frame to absorb forces subjected to it, during normal operation of the pistol. The frame halts the high speed movement of the metallic parts (relative to the frame) during operation of the pistol and forces created by the movement of the metallic parts, in many instances, are directed into the frame. Prior pistols such as the one shown and described in U.S. Pat. No. 5,741,996 have used camming elements to distribute forces to a non-metallic frame.

SUMMARY OF THE INVENTION

Broadly, a novel firearm having a synthetic polymer frame and a metallic reciprocating slide is provided with a camblock that engages a metallic chamber block of a barrel assembly during recoil. A camblock assembly includes the camblock member which is secured to a guide rod, and a front flange of the camblock has multiple flange surfaces that engage corresponding bearing surfaces of the frame. A shelf member is positioned at a front end of the camblock to resist movement of the reciprocating slide during recoil. A coiled flat wire buffer spring is positioned about the guide rod proximate the front flange to further resist movement of the reciprocating slide.

A slide stop pin passes through openings of the frame and the camblock and a detent mechanism positioned within the camblock contacts the slide stop pin to hold it in place. A slide stop latch has an elongated wire positioned within its internal side with one end of the wire positioned for engagement with the frame such that the elongated wire biases the slide stop latch in a down position. The slide stop pin and the camblock function to distribute forces to the frame.

DETAILED DESCRIPTION

Figure 1:
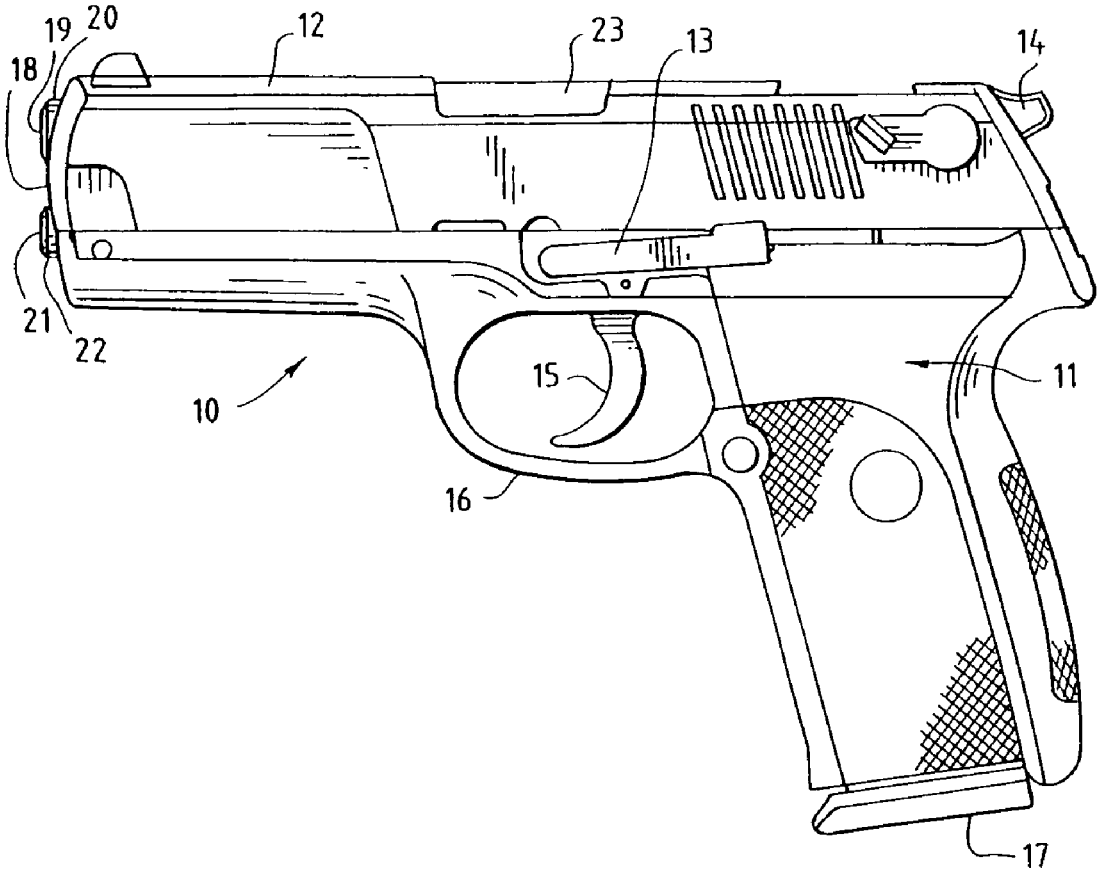
FIG. 1 is a side elevational view of the firearm of the present invention.

Referring to FIG. 1, pistol 10 is shown having synthetic polymer frame 11, reciprocating slide 12, slide stop latch 13, hammer 14, trigger 15, trigger guard 16, and magazine 17. Extending slightly down from front end 18 of slide 12 is muzzle portion 19 of barrel 20 and front end 21 of guide rod 22. Chamber block 23 is shown positioned at a top opening of the reciprocating slide 12.

Figure 2:
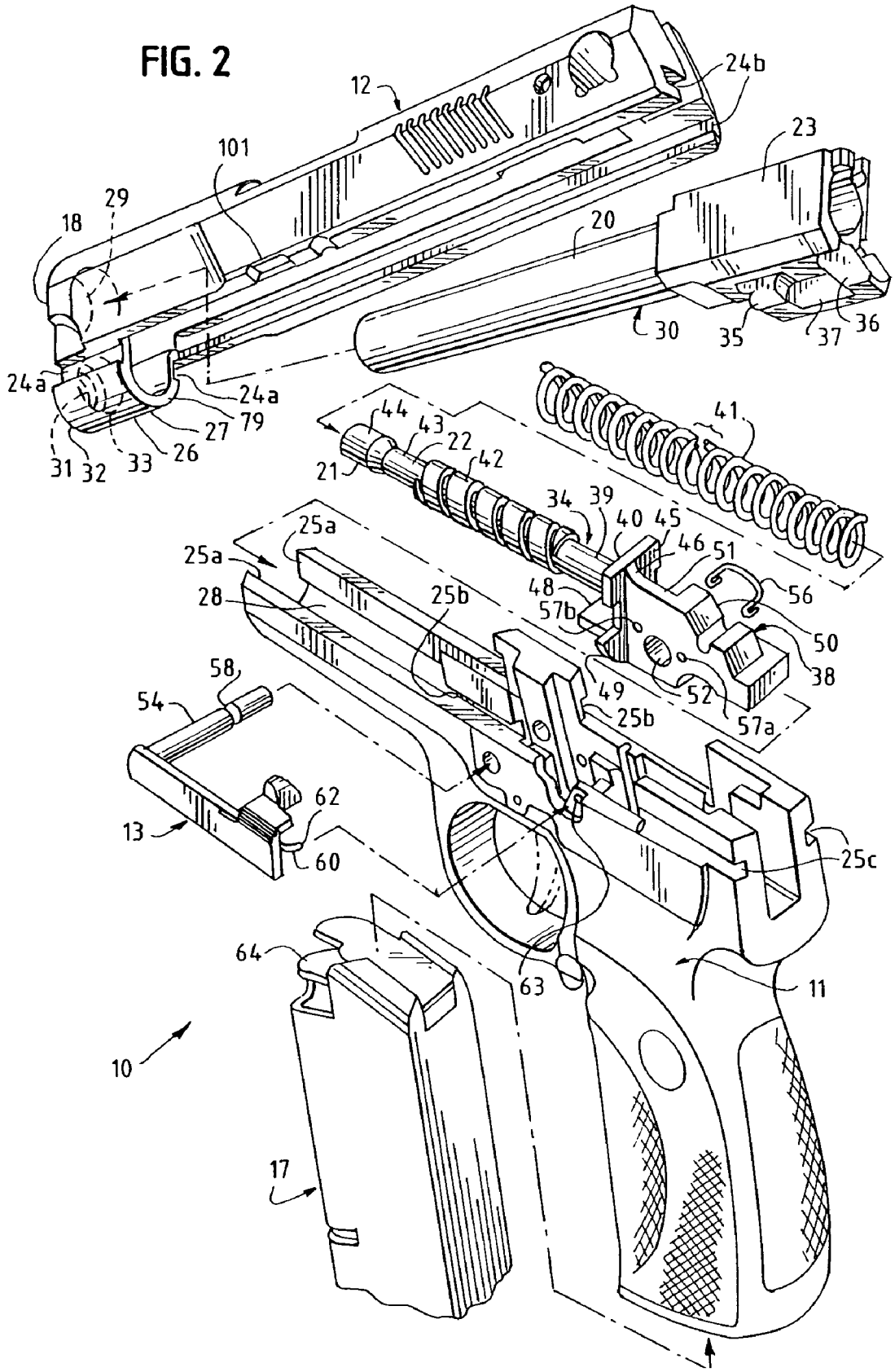
FIG. 2 is an exploded perspective view of the firearm showing the slide, barrel assembly, camblock assembly, and the frame.

Referring now to FIG. 2, slide 12 includes integrally formed grooves 24*a*, 24*b* which communicate with integrally formed guide rails 25*a*, 25*b*, 25*c* of frame 11 for securement to and lateral movement of the slide 12 along the top of frame 11. A lower portion 26 of the metallic reciprocating slide 12 has a curved bottom surface 27 which sits in and moves along a corresponding curved surface 28 of frame 11 during recoil. Forward slide guide rails 25*a* of frame 11 communicate with mating front grooves 24*a* of slide 11 to hold the slide down and allow the slide to move along slide guide rails 25*a* during recoil. Front end 18 of slide 12 is shown having barrel bore 29 that receives the barrel portion 20 of barrel assembly 30. Guide rod bore 31 has an outer end 32 and an interior end 33 for receipt of guide rod 22 of camblock assembly 34. Barrel assembly 30 includes forward barrel portion 20 and rear chamber block 23. Lower region of metallic chamber block 23 includes front camming projection 35 and rear camming projection 36 with chamber reinforcement wall 37 positioned between and interconnecting front projection 35 and rear projection 36.

Positioned below barrel assembly 30 is camblock assembly 34. Camblock assembly 34 includes camblock 38 and guide rod 22 in which a rear portion 39 of guide rod 22 is secured to a front end 40 of camblock 38. Front portion 21 of guide rod 22 is positioned within guide rod bore 31 of slide 12 and recoil spring 41 is positioned about and is supported by guide rod 22. Coiled flat wire buffer spring 42 is also positioned about guide rod 22 and during operation of the firearm 10 the buffer spring 42 is positioned proximate to the connection of the guide rod 22 at the front end 40 of metallic camblock 38. (See FIGS. 4 and 5). Front portion 21 of guide rod 22, as seen in FIG. 2, tapers from a wider portion 44 to a narrow portion 43 to contain flat wire buffer spring 42 on guide rod 22. Camblock 38 includes front flange 45 which is positioned proximate rear portion of guide rod 39 and proximate forward portion 46 of camblock 38. Front shelf 48 located at front end 40 of camblock 38 is connected to a lower portion 49 of front flange 45. Camblock 38 is arranged below chamber block 23 and includes a camming projection 50 which engages the front projection 35 of chamber block 23 during operation of pistol 10. Reinforcement wall 51 of camblock 38 is positioned between and interconnects front flange 45 and camming projection 50.

Figure 6:
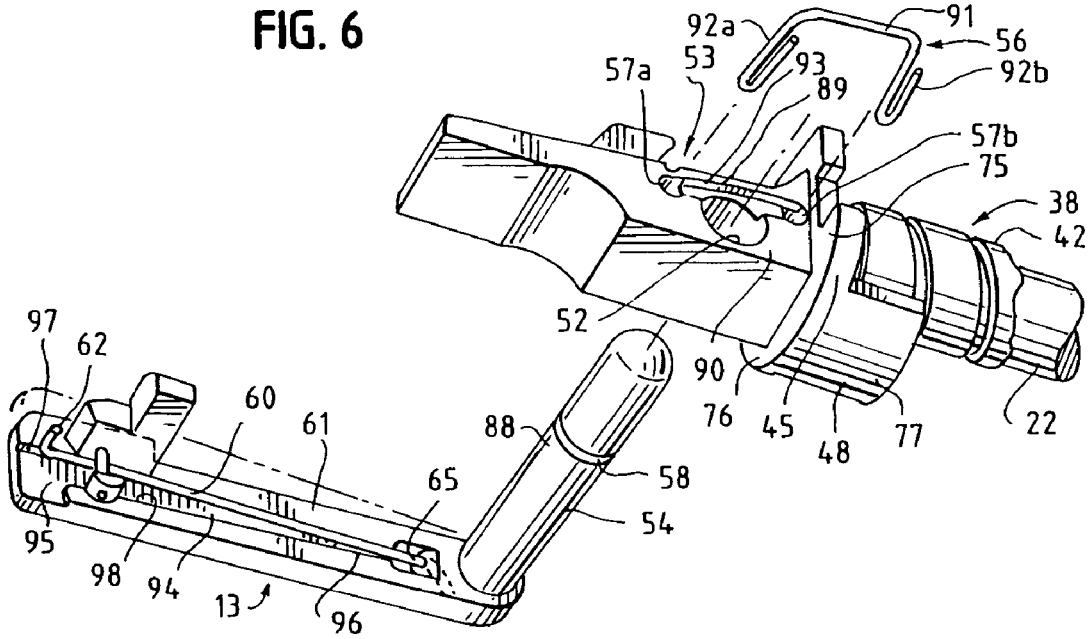
FIG. 6 is an exploded view illustrating a slide stop latch and a wire form of a detent mechanism removed from the camblock.
Figure 7:
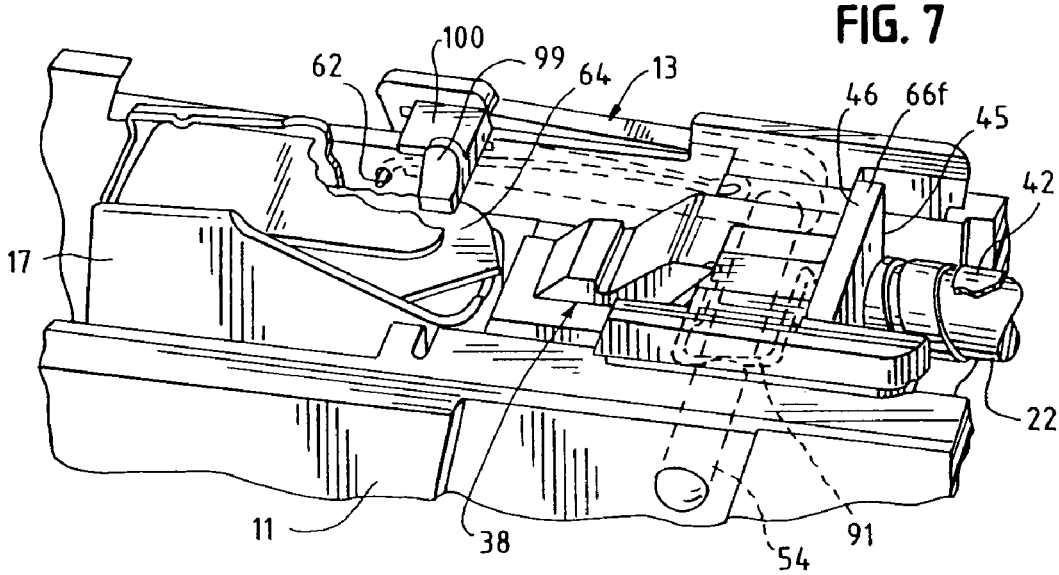
FIG. 7 is a partial elevated perspective view of the camblock assembly, slide stop latch and magazine positioned within the frame.
Figure 8:
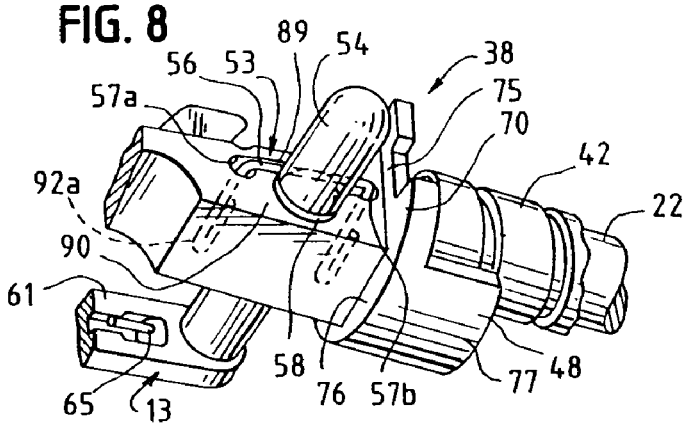
FIG. 8 is a partial lower view illustrating the slide stop pin inserted into the camblock.

Transverse opening 52 of camblock 38 is employed for receipt of slide stop pin 54 of slide stop latch 13. Frame 11 also has a slide stop openings 55*a*, 55*b* that align with transverse opening 52 of camblock to hold slide stop pin 54 upon insertion of the slide stop latch 13. Camblock 38 houses a wire form member 56 held by retainment bores 57*a*, 57*b* which engages groove 58 of slide stop pin 54 upon insertion of slide stop latch 13. As also seen in FIGS. 6-8, slide stop latch 13 includes elongated wire 60 positioned in an interior portion 61 of the slide stop latch 13 with one end 62 of the elongated wire being bent outwards for insertion and positioning within a corresponding bore 63 of frame 11 (FIG. 2). Also seen in FIG. 2, is magazine 17, having magazine follower 64, that is insertable and is held within frame 11 of pistol 10.

Figure 3:
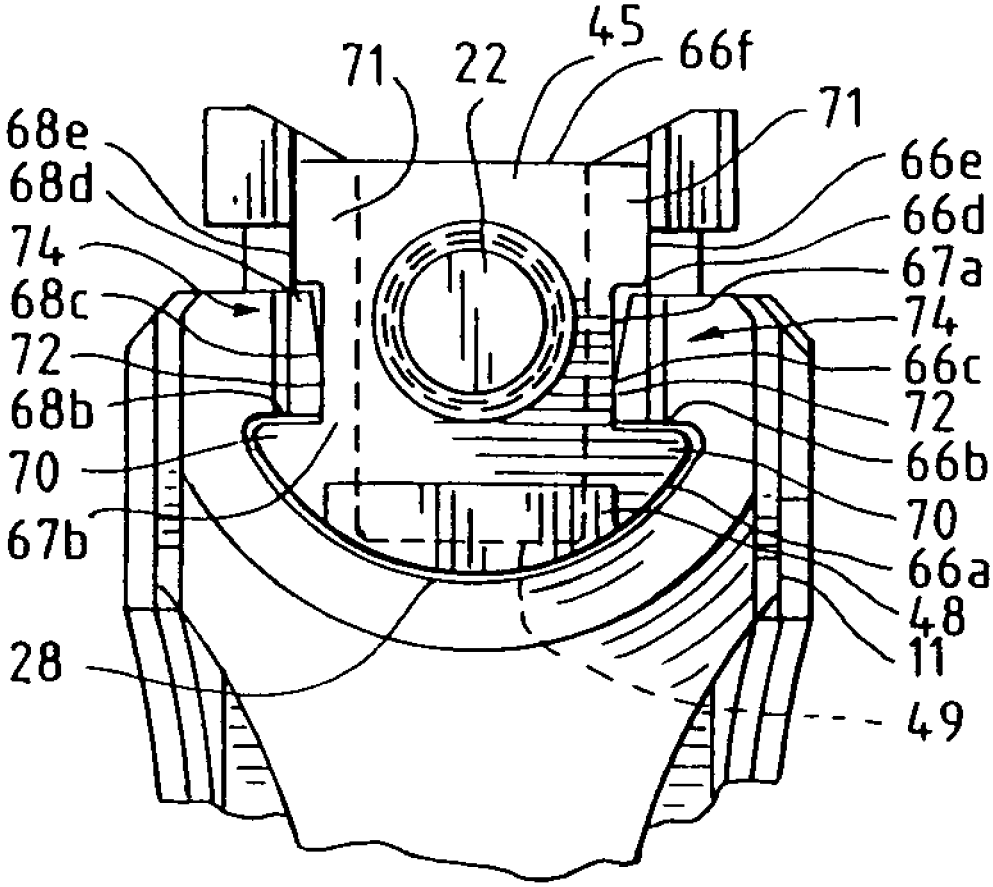
FIG. 3 is a sectional front view of the camblock illustrating the front flange positioned within the frame.
Figure 9:
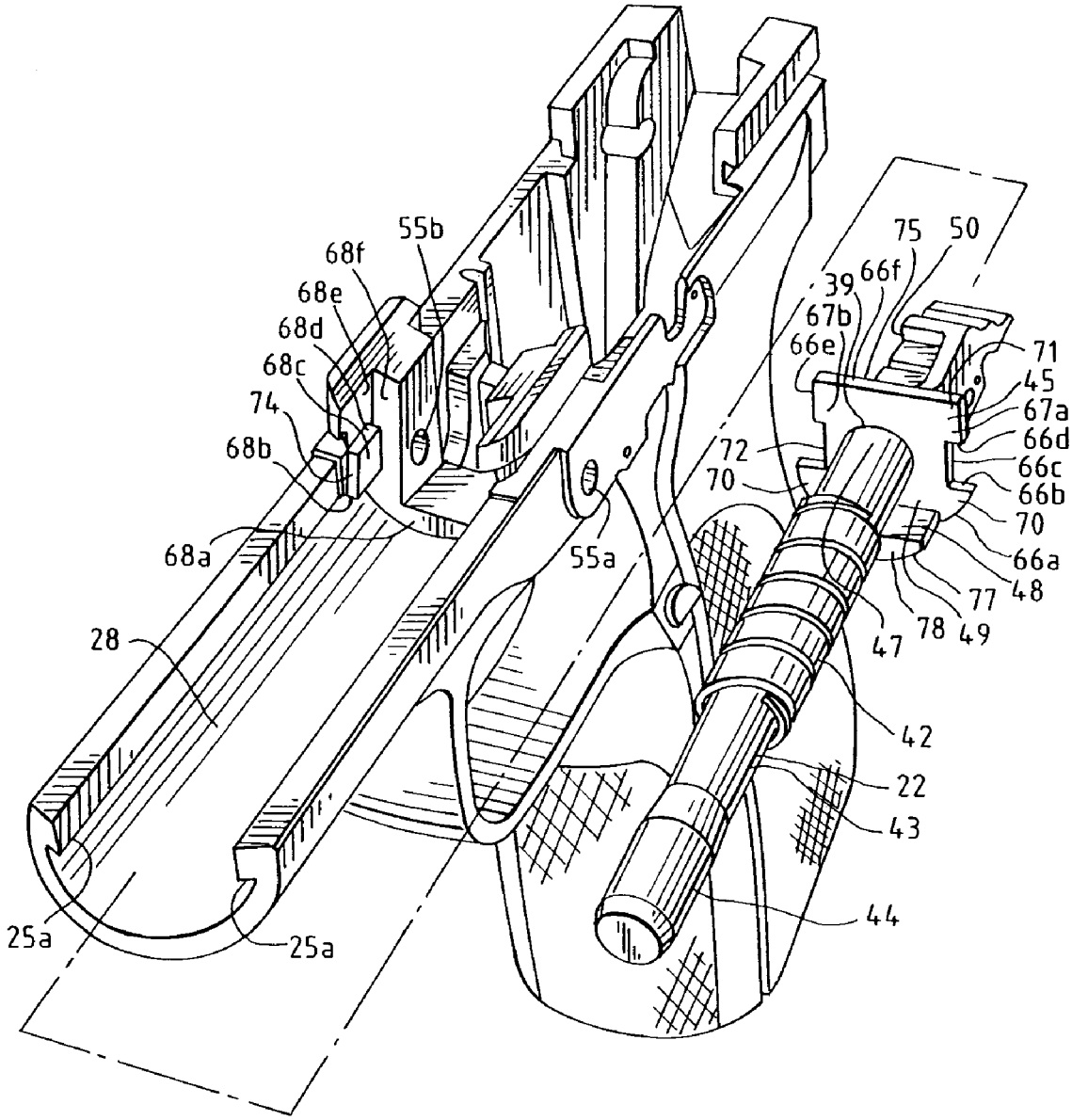
FIG. 9 is an exploded elevated perspective view of the frame and the camblock assembly.

With reference now to FIGS. 2-9, front flange 45 has flange surfaces 66*a*-66*f* which align with and are fitted for engagement with various bearing surfaces 28, 68*a*-68*f* of the frame 11. In particular, front flange 45 has curved bottom flange surface 66*a* which sits in and contacts complimentary curved surface 28 of frame 11. (See FIGS. 3 and 9). Front flange 45 includes top flange surface 66*f*, curved bottom flange surface 66*a* and two side sections 67*a*, 67*b* positioned between top flange surface 66*f* and bottom flange surface 66*a*. The two side sections 67*a*, 67*b* each having a lateral extension portion 70, an upper extension portion 71, and a vertical sidewall 72, positioned between upper extension portion 71 and lateral extension portion 70. Frame 11 has a pair of rail members 74 which each mate with a corresponding side section 67*a*, 67*b* of front flange 45 such that rail members 74 each have a bottom rail surface 68*b* that engages top surface 66*b* of lateral extension portions 70, as seen in FIGS. 3 and 9. Rail members 74 also each have top rail surface 68*d* that engages bottom surface 66*d* of the upper extension portions 71. As seen in FIG. 3, the lateral extension portions 70 of front flange 45 are trapped underneath rail members 74 molded into frame 11 to hold the camblock 38 down during firing and to increase the amount of load bearing surface between the flange 45 and the frame 11.

As seen in FIG. 9, synthetic polymer frame 11 has backing members 68*f* which engage and abut against a back side 75 of front flange 45 for positioning of the front flange within the frame. Vertical backing member 68*f* abuts against the back side 75 of front flange 45 proximate side section 67*b* and extends from top flange surface 66*f* to the bottom flange surface 66*a*. Another vertical backing a member (not shown) preferably having the same structure and dimension as backing member 68*f* (seen in FIG. 9) is also provided for abutment proximate side section 67*a* of front flange 45. Horizontal backing member 68*a* of plastic frame 11 extends from the curved bottom surface 28 and engages a lower back portion 76 (FIGS. 6, 8) of the front flange. When positioned in synthetic polymer frame 11, upper extension portions 71 of front flange 45 engage side frame walls 68*e* of the frame.

Figure 4:
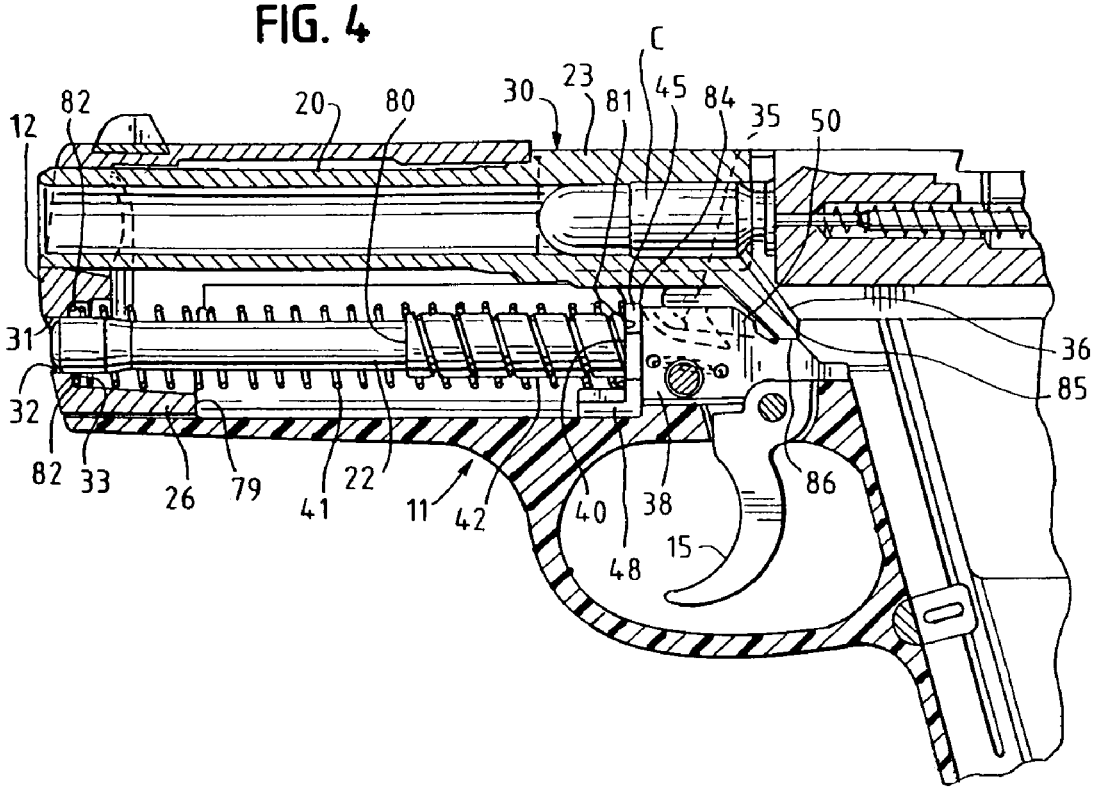
FIG. 4 is a partial sectional view taken parallel to the axis of the barrel showing the barrel assembly having barrel and chamber block, the camblock assembly with guide rod and camblock, the slide and frame, all in a locked up fire position.
Figure 5:
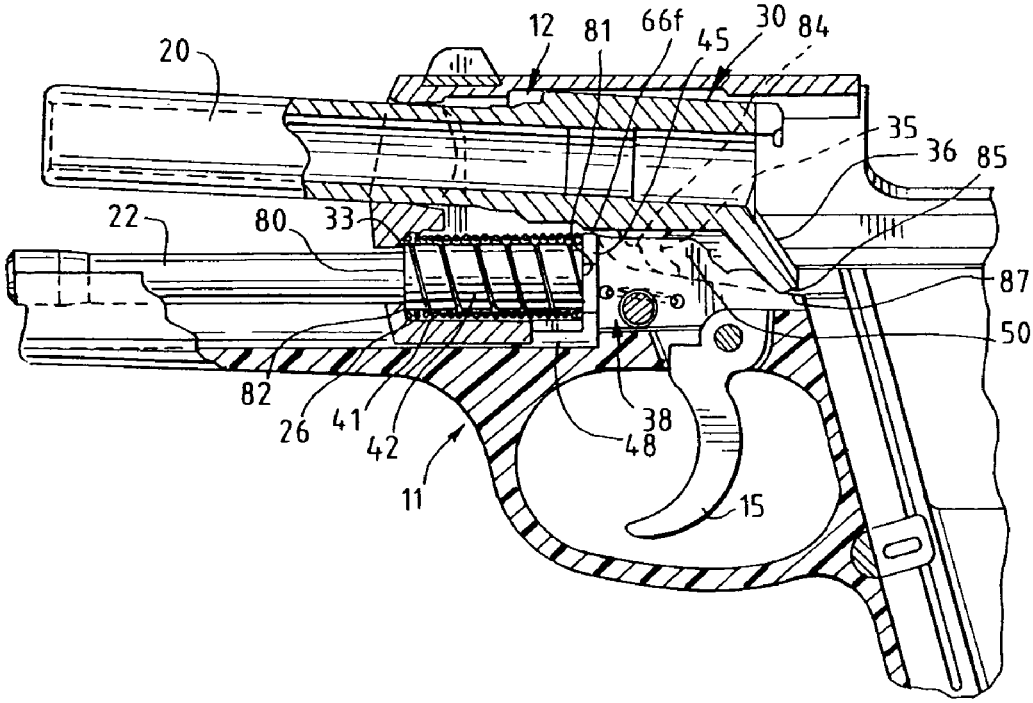
FIG. 5 is a view similar to FIG. 4 with the barrel assembly cammed back to its full rearward position and the slide moved to its full rearward position.

Connected to a lower portion 49 of front flange 45 is shelf member 48, FIGS. 2-9, which extends in a forward direction to resist movement of reciprocating slide 12 during recoil. In particular, shelf member 48 extends from lower front section 49 of camblock 38 and is positioned to make contact with lower portion 26 of slide 12 during recoil. The front flange 48 is connected with rear end 39 of guide rod 22 and the shelf member 48 is connected with lower portion 49 of front flange 45. Shelf member 48 is located below rear portion 47 of guide rod 22 and coiled flat wire buffer spring 42 and extends in a direction substantially parallel with guide rod 22 towards front end 18 of slide 12. (See FIGS. 4 and 5). As with the front flange, shelf member 48 has a curved bottom surface 77 (FIGS. 6, 8) which sits in a complimentary curved surface 28 of frame 11. As seen in FIG. 5, during recoil front shelf 48 of camblock 38 directly contacts curved back end 79 of lower portion 26 of slide 12 such that front face 78 of shelf 48 acts as a significant frame stop surface.

As seen in FIGS. 4 and 5, coiled flat wire buffer spring 42 about guide rod 22 is positioned inside of recoil spring 41. Buffer spring 42 is sprung assembled on guide rod 22 such that front end 80 of buffer spring 42 faces guide rod bore 31 of slide 12 and back end 81 of buffer spring 42 faces front flange 45 at the front portion of camblock 38. (FIG. 4). Buffer spring 42 is preferably constructed of spring tempered steel material. As seen in FIG. 5, when trigger 15 is pulled and the firearm fires, recoil forces cause the slide 12 to move rearwardly toward camblock 38. Recoil spring 41 compresses and is pushed by reciprocating slide 12 back towards front flange 45. In addition, as the lower front portion 26 of slide 12 begins to approach the camblock 38, a surrounding area 82 about the interior end 33 of guide rod bore 31 engages front end 80 of coiled flat wire buffer spring 42. Back end 81 of buffer spring 42 engages front portion 40 of camblock 38 and makes contact with the front flange 45 proximate the connection point with guide rod 22 such that buffer spring 42 compresses and resists the backward movement of the reciprocating slide 12.

Referring to FIG. 4, chamber block 23 which receives cartridge C as loaded and from which cartridge case is extracted after firing (FIG. 5), has front camming projection 35 and rear camming projection 36 extending from a lower region of chamber block 23. When pistol 10 is in the locked up fire position, FIG. 4, a mounting surface 84 positioned slightly ahead of front cammming projection 35 of the chamber block 23 rests atop of the top flange surface 66*f* of front flange 45. Flat bottom surface 85 of rear camming projection 36 rests atop a corresponding flat camming surface 86 of camblock 38. When trigger 15 is pulled and pistol 10 fires (FIG. 5), recoil forces cause slide 12 to move rearwardly against recoil spring 41 until front camming projection 35 of chamber block abruptly contacts camming projection 50 of camblock 38 and flat bottom surface 85 of rear camming projection 36 engages a rear camming surface 87 of the camblock 38. Upon firing, barrel assembly 30 moves back and down and chamber block 23 disengages from slide 12.

The barrel assembly 30 is accelerated to a high speed by movement of the slide 12 in which the acceleration and rotational movement back and down continue until the front and rear end camming portions 35, 36 of the lower portion of the barrel 20 are abruptly stopped by engagement with the camblock 38. Additionally, slide 12 quickly accelerates rearwardly upon firing until the lower front portion 26 of slide 12 contacts the front shelf 48 of camblock 38 thereby stopping further backward movement of the slide. Buffer spring 42 is positioned about guide rod 22 such that its front end 80 engages the surrounding area of the interior end 33 of guide rod bore 31 at the front of the slide 12. The back end 81 of buffer spring 42 abuts against the front flange 45 thereby enabling buffer spring 42 to compress and resist the rearward movement of the slide 12. Forces and energy from stopping rapid movement of the slide 12 and the stopping of the barrel assembly 30 are transferred to camblock 38, and in turn to non-metallic synthetic polymer frame 11 by the various camblock surfaces including the significant number of flange surfaces 66*a*-66*f* which bear against many bearing surfaces 28, 68*a*-68*f* of the frame. The slide 12 and barrel assembly 30 forces are also transferred into the slide stop pin 54 and are absorbed into the frame 11 by the pin 54 which passes through frame holes 55*a*, 55*b* (FIG. 9).

Referring now to FIGS. 2 and 6-8, positioned within camblock 38 is detent mechanism 53 which engages a surface 88 of slide stop pin 54 to hold the slide stop pin in place upon insertion of the slide stop latch 13 to the frame 11 of firearm 10. Detent mechanism 53 includes wire form 56 which extends across a top portion 89 of transverse opening 52 of camblock 38. Slide stop pin 54 is inserted through slide stop opening 55*a*, 55*b* of frame 11 as well as the transverse opening 52 of camblock 38. Wire form 56 (FIG. 6) extends across top portion 89 of transverse opening 52 at the distal side 90 of camblock 38 which is the side opposite to where the slide stop pin 54 is inserted into the camblock 38. Slide stop pin 54 has a circumferential groove 58 formed about pin surface 88 whereby upon insertion of the slide stop pin 54 through transverse opening 52 of the camblock 38, the detent mechanism 53 spring biases down into engagement with the groove 58 for securement of the slide stop pin within the camblock. As seen in FIG. 6, wire form 56 includes an intermediate portion 91 positioned between two looped portions 92*a*, 92*b*. The camblock 38 has a pair of retainment bores 57*a*, 57*b* formed on opposite sides of the transverse opening 52 and the retainment bores house looped portions 92*a*, 92*b* of the wire form 56. The camblock 38 contains a channel 93 extending between the retainment bores 57*a*, 57*b* for receipt of the intermediate portion 91 of the wire form 56 which engages groove 58 of the slide stop pin 54.

Positioned within an interior portion 61 of slide stop latch 13 is elongated wire 60, as seen in FIG. 6. The elongated wire has two ends 62, 65 with one end 62 bent outwards in a direction that is in alignment with slide stop pin 54 and is positioned for receipt in a corresponding bore 63 of frame 11 (see FIG. 2). The other end 65 of the elongated wire 60 is held within the slide stop latch 13. (See FIGS. 6-8). The interior portion 61 of the slide stop latch 13 has a tapered channel 94 which houses elongated wire 60. Tapered channel 94 has a wide portion 95 proximate end 62 of elongated wire 60 and a narrow portion 96 proximate the other end 65 which is fixedly held within the interior portion 61 of slide stop latch 13. (FIG. 6). The elongated wire 60 rides along a top edge 97 of the tapered channel 94 thereby spring biasing the slide stop latch 13 to be held in a down position when the slide stop latch is inserted into the frame 11. The elongated wire 60 is able to be pivoted from the held position where it engages the top edge 97 of the tapered channel 94 to a pivoted position whereby the elongated wire contacts a bottom edge 98 of the tapered channel 94 upon the user applying an upward force to the slide stop latch 13 when the latch is inserted into frame 11 and pistol 10 is assembled.

As noted above, the elongated wire 60, positioned within tapered channel 94, spring biases the slide stop latch 13 in a down position during firing operation of the pistol 10. However, as seen in FIG. 7, when magazine 17 is empty, magazine follower 64 contacts extension member 99 of slide stop latch 13 and applies an upward force to the slide stop latch such that the latch 13 pivots in an upward direction whereby the elongated wire 60 is moved down and engages the bottom edge 98 of the tapered channel 94. It will be understood that the interior of magazine 17 contains one or more springs (not shown) which apply an upward force on magazine follower 64 to push extension member 99 of slide stop latch 13 in an upward direction. When pushed in the upward direction, slide engagement block 100 of the extension member 99 is moved upward and is enabled to be locked into position with mating notch 101 (FIG. 2) of the reciprocating slide 12 to hold the slide in the rearward position when magazine 17 is empty of cartridges.

Although certain embodiments have been depicted and described in detail herein, it will be apparent to those skilled in the relevant art that various modifications, additions, substitutions and the like can be made without departing from the spirit of the invention and these are therefore considered to be within the scope of the invention. While a detailed description of certain embodiments has been provided, it should be appreciated that many variations can be made thereto without departing from the scope of the appended claims.

What is claimed is:

1. A firearm having a frame, a reciprocating slide and a barrel assembly, comprising:

a camblock assembly having a camblock and a guide rod in which the guide rod is secured to the camblock, the camblock assembly positioned adjacent to the barrel assembly, and at least a portion of the camblock assembly is housed by the frame and the reciprocating slide; and a shelf member positioned at a front end of the camblock and extending in a forward direction to make contact with, and resist movement of, the reciprocating slide as the reciprocating slide moves back during recoil of the firearm.

2. The firearm of claim 1 in which the shelf member extends from a lower front section of the camblock and is positioned to make contact with a lower portion of the reciprocating slide during recoil.

3. The firearm of claim 2 in which the shelf member is located below a rear portion of the guide rod.

4. The firearm of claim 3 in which the shelf member extends in a direction substantially parallel with the guide rod.

5. The firearm of claim 3 in which the camblock has a front flange connected with a rear end of the guide rod and in which the shelf member is connected to a lower portion of the front flange.

6. The firearm of claim 2 in which the shelf member has a curved bottom surface which sits in a complimentary curved surface of the frame.

7. The firearm of claim 6 in which the lower portion of the reciprocating slide has a curved bottom surface which sits in and moves along the curved surface of the frame during recoil.

* * * * *